US006975064B2

(12) United States Patent
Lee

(10) Patent No.: US 6,975,064 B2
(45) Date of Patent: Dec. 13, 2005

(54) CATHODE RAY TUBE HAVING FUNNEL WITH A REVERSE CURVATURE

(75) Inventor: Kwang Soon Lee, Gumi-shi (KR)

(73) Assignee: Orion Electric Co., Ltd., (KR)

( * ) Notice: Subject to any disclaimer, the term of this patent is extended or adjusted under 35 U.S.C. 154(b) by 60 days.

(21) Appl. No.: 10/476,212

(22) PCT Filed: Jan. 31, 2002

(86) PCT No.: PCT/KR02/00144

§ 371 (c)(1),
(2), (4) Date: Oct. 28, 2003

(87) PCT Pub. No.: WO02/089170

PCT Pub. Date: Nov. 7, 2002

(65) Prior Publication Data

US 2004/0150314 A1 Aug. 5, 2004

(30) Foreign Application Priority Data

Apr. 28, 2001 (KR) ..... 2001-23229

(51) Int. Cl.[7] ..... H01J 29/70
(52) U.S. Cl. ..... 313/440; 313/477 R
(58) Field of Search ..... 313/440, 477 R, 313/495; 220/2.1 R, 2.1 A

(56) References Cited

U.S. PATENT DOCUMENTS 6,541,902 B1 * 4/2003 Carpinelli et al. ..... 313/421

* cited by examiner

*Primary Examiner*—Vip Patel
(74) *Attorney, Agent, or Firm*—Sterne, Kessler, Goldstein & Fox P.L.L.C.

(57) ABSTRACT

This invention relates to a cathode ray tube having a funnel in the shape of a reverse curvature designed to improve the strength for the glass manufacturing process and test specification. In the present invention, a reverse radius is applied to the whole of the rear-side glass, which is the funnel, of the cathode ray tube. Therefore, the cathode ray tube has a high degree of strength for vacuum and a low weight, so that it can have a wide angle of the electric beam in accordance with the enlargement and the flattening plane of the cathode ray tube. The cathode ray tube that has the funnel in the shape of the reverse curvature comprises: a yoke on which a deflection coil is placed; and a body part that extends from the yoke toward an opening terminal attached to the panel. The center of a curvature in the yoke is located outside of the cathode ray tube; the center of a curvature in the body part extending from the yoke is located outside of the cathode ray tube; and the center of the curvature in the vicinity of the opening terminal of the body part is located inside of the cathode ray tube. Therefore, an inflection point is located in the body part in the vicinity of the opening terminal.

6 Claims, 10 Drawing Sheets

SMN=-.905773
SMX=3.508
———— =-.660538
---------- =-.170068
—— - —— =.320401
---------- =.810871
———— =1.301
---------- =1.792
———— =2.282
---------- =2.773
———— =3.263

CATHODE RAY TUBE HAVING FUNNEL WITH A REVERSE CURVATURE

BACKGROUND OF THE INVENTION

1. Field of the Invention

The present invention generally relates to a cathode ray tube having a funnel with a reverse curvature, and more particularly, to a cathode ray tube having a funnel with the strength for dealing with internal vacuum and implosion condition by applying a reverse radius to the whole rear-side glass (that is, a "funnel") of the cathode ray tube. Therefore, the cathode ray tube of the present invention has the strength satisfying the requirement of the glass manufacturing process and test specification of a funnel for a cathode ray tube.

2. Description of the Prior Art

A funnel, which is a funnel for a conventional cathode ray tube (hereinafter, referred to as 'CRT'), forms an optimum curve by combining various kinds of curves in its design. Recently, it has required that the structure of CRT can shorten the external length of a tube axis direction and accomplish large deflection of electric beams according to scale-up and complanation of the CRT. However, the funnel that satisfies large deflection and narrow CRT has been degraded characteristics of vacuum resistant stress and implosion proof. Accordingly, a funnel is required to have high strength and satisfy large deflection and narrow CRT. In the conventional funnel design, center of curvature up to a yoke portion is located at the outer side of the CRT, while that of a body portion in the funnel on the inner side of the CRT.

Referring to FIG. 1, a recent cathode ray tube has a glass bulb of high vacuum comprising a panel 1 and a funnel 2. The panel 1 is formed of glass displaying image basically. The funnel 2 is formed of glass having a neck portion 5 for receiving an electric gun 6, a yoke portion 4 and a body portion 3. On the yoke portion 4, a deflecting coil 7 is mounted. The body portion 3 extends from the yoke portion 4 toward an opening terminal portion that the panel 1 is attached. Referring to solid lines in FIGS. 1 and 3, curvature r1 of the yoke portion 4 places its center on the outer side of the CRT while curvature r2 of the body portion 3 places its center on the inner side of the CRT. As a result, an inflection point 15 is located between the yoke portion 4 and the body portion 5.

The CRT having the structure as described above can shorten the external length of a tube axis direction and accomplish large deflection of electric beams according to scale-up and complanation of the CRT. However, the strength for preventing implosion of the funnel at the internal vacuum condition of the CRT is attenuated. As the length of the tube axis direction become shorter, the body portion 3 of the funnel becomes relatively wider. As a result, as shown in FIG. 1, the thickness of the body portion 3 becomes thicker, and its stress becomes more increasing. Since this point causes the weight of the CRT to become larger and heavier, it is an important problem in a glass manufacturing process, manipulation and transport of the CRT.

The Japanese Patent Application No. 2000-251766 (published on Sep. 14, 2000) shows an attempt to overcome the above-described problem of the conventional CRT. Referring to FIG. 2, a funnel 2' includes a protrusion 8' wherein a body portion 3 around a yoke portion 4 is projected to the outer side side, thereby increasing the vacuum resistant strength and minimizing the increase in thickness of the body portion 3. As a result, the weight of a CRT becomes lighter. In this way, by forming the protrusion 8', a ring-shaped groove bottom 9 is formed around a yoke portion 4, and a deflecting coil 7 is mounted therebetween.

However, in the above-described Japanese Patent Application, it is difficult to fabricate the funnel 2' because the structure of the funnel 2' is complicated. In addition, it is difficult to apply the structure of the conventional deflecting coil 7 and electric gun 6 to the CRT. This application requires new equipment to mount the deflecting coil 7 or the electric gun 6. As a result, its installment becomes difficult.

SUMMARY OF THE INVENTION

Accordingly, it is an object of the present invention to provides a CRT applying a reverse radius to the whole rear-side glass (funnel) to cope with the scale-up and complanation of the CRT, so that the CRT has the light weight and excellent vacuum resistant strength and satisfies large deflection of electric beams.

To achieve the above-described object, there is a cathode ray tube having a funnel with a reverse curvature, comprising: a yoke portion on which deflection coil is placed, and a body portion extending from the yoke portion toward an opening terminal portion to be attached to a panel, wherein a inflection point is located far from the yoke portion by placing a center of curvature in the body portion extending from the yoke portion on the outer side of a cathode ray tube and placing a center of curvature in the yoke portion on the outer side of the cathode ray tube.

There is also provided the cathode ray tube having a funnel with a reverse curvature wherein a center of curvature R1 in the yoke portion is located at the outer side of a cathode ray tube, centers of curvatures R2 and R3 of the yoke portion near to a body portion extending from the yoke portion is located at the outer side of the cathode ray tube, and a center of curvature R4 of an opening terminal portion near to the body portion is located at the inner side of the cathode ray tube, thereby an inflection point is located in the body portion near to the opening terminal portion.

There is also provided the cathode ray tube having a funnel with a reverse curvature wherein curvatures R2 and R3 of the yoke portion near to the body portion includes a plurality of curvatures.

There is also provided the cathode ray tube having a funnel with a reverse curvature wherein the inflection point is located near the opening terminal portion wherein the funnel has the thickest thickness.

There is also provided the cathode ray tube having a funnel with a reverse curvature: wherein the body portion includes a lateral body portion extending from the opening terminal portion and a continuous body portion connecting the lateral body portion to the yoke portion; wherein if the whole straight length from the origin of the opening terminal portion to the yoke portion is 100, the opening terminal portion is 0.2, the lateral body portion is 13.8, the continuous body portion is 48, and the yoke portion is 38; where the center of curvature in the continuous body portion connecting the lateral body portion to the yoke portion is located at the outer side of a cathode ray tube to maintain the structure of the reverse curvature.

BRIEF DESCRIPTION OF THE DRAWINGS

A more complete appreciation of the present invention, and many of the attendant advantages thereof, will be readily apparent as the same becomes better understood by reference to the following detailed description when considered in conjunction with the accompanying drawings, wherein.

DESCRIPTION OF THE PREFERRED EMBODIMENTS

Figure 3:
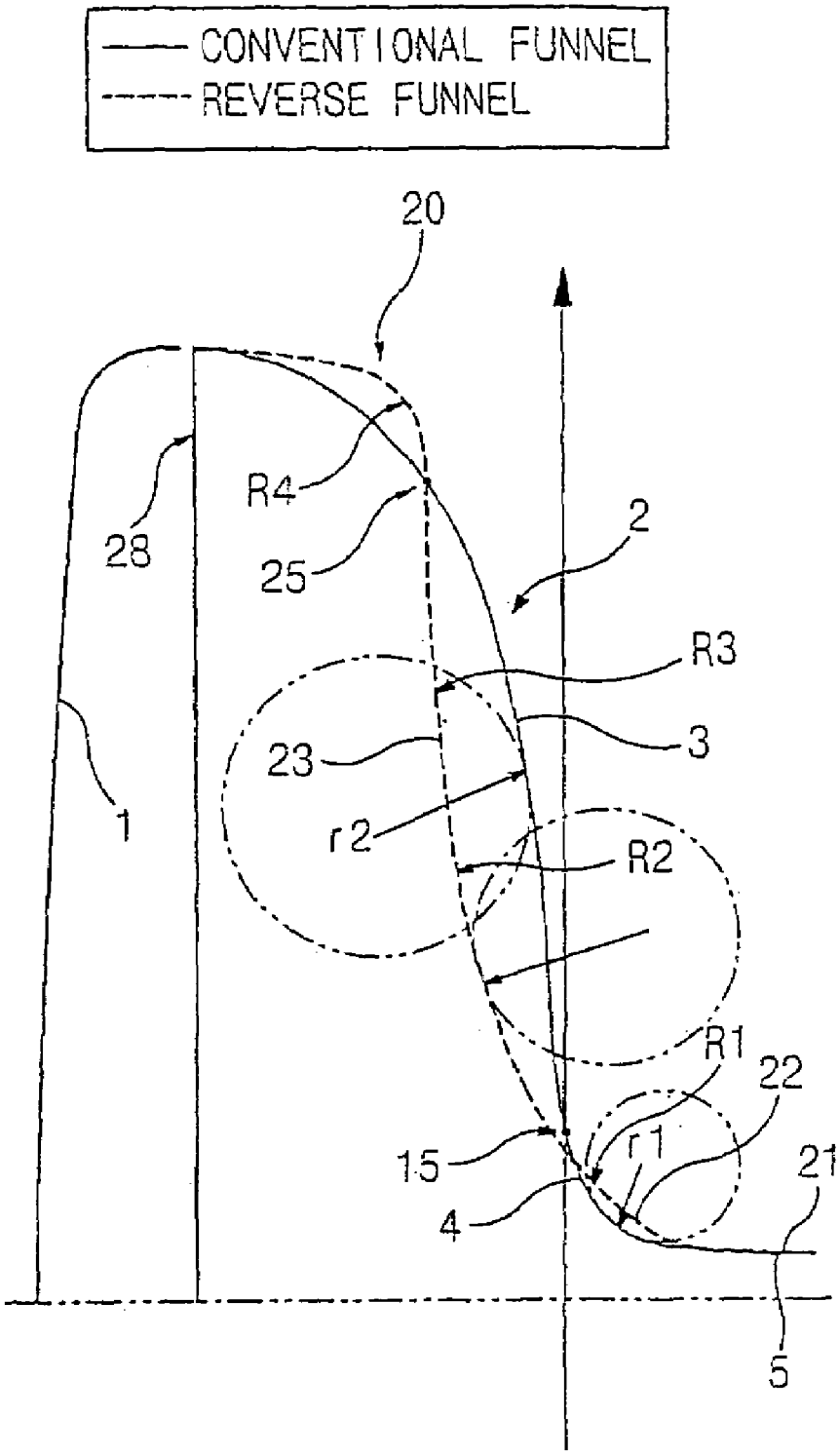
FIG. 3 is a cross-sectional diagram illustrating a structure of a reverse curvature in a funnel for a CRT in accordance with a preferred embodiment of the present invention.

FIG. 3 illustrates a cross-sectional diagram a structure of a reverse curvature (shown as a dotted line) in a funnel for a CRT in accordance with a preferred embodiment of the present invention, including a structure of a conventional curvature (shown as a solid line).

As shown on the solid line in FIG. 3, a conventional funnel was in a structure combining various kinds of circular arcs and then forming a proper curvature to obtain strength for dealing with vacuum and implosion condition. However, inventor has known that the strength of a funnel can be improved by placing center of curvature of circular arcs consisting of the funnel on the outer side of the CRT. In general, a yoke portion 4 and a portion connected to a panel 1 in a body portion 3 have large stress. However, the thickness of the yoke portion 4 is relatively thin, thereby resulting in weakest stress resistant strength therein. Accordingly, it is important that a CRT should be designed not to concentrate stress to the yoke portion 4. In the point of mathematics, center of curvature r1 in the yoke portion 4 is located at the outer side of the CRT while center of curvature r2 in the body portion 3 extending from the yoke portion 4 is located at the inner side of the CRT, thereby resulting in a inflection point wherein a curvature is changed into an opposite direction. Due to this reason, the yoke portion 4 has the stress concentration. As a result, the vacuum resistant strength should be improved by transferring the inflection point to a portion having the high degree of stress resistant strength, that is, the body portion 3 wherein the thickness is relatively thick.

A CRT of the present invention has a structure wherein a center of a curvature in a body portion adjacent to a yoke portion is located at the same side as that of a curvature in the yoke portion, that is, centers of curvatures are located at the outer side of the CRT.

As shown on the dotted line in FIG. 3, a funnel 20 of the present invention includes a yoke portion 22 whereon deflecting coils are mounted, and a body portion 23 extending from the yoke portion 22 toward an opening terminal portion 28 that a panel 1 is attached. Center of curvature R1 in the yoke portion 22 is located at the outer side of the CRT such as the conventional one. Centers of curvatures R2 and R3 in the yoke portion of the body portion 23 extended from the yoke portion 22 are also located at the outer side of the CRT such as center of curvature of the yoke portion 22.

Center of curvature R4 around the opening terminal portion 28 of the body portion 23, which is a flange portion attached to the panel 1, is located at the inner side of the CRT. As shown in FIG. 3, an inflection point 25 is located on the body portion 23 apart from the yoke portion 22, wherein its thickness is relatively thicker than the other portions of the funnel so that the vacuum resistant strength is strong.

An inflection point 15 in the conventional curvature is placed on the yoke portion wherein the vacuum resistant strength is weak. However, the inflection point 25 in the present invention is located on the body portion 23 adjacent to the opening terminal portion 28 having the strong vacuum resistant strength, apart from the yoke portion 22.

In this way, curvatures R2 and R3 of the yoke portion in the body portion 23, which their centers is located at the outer side of the CRT, is formed with a plurality of curvatures. As a result, they may be optimized in consideration of lengths of long and short sides.

In addition, the body portion 23 has centers of curvatures R2 and R3 located at the outer side of the CRT. As a result, the inflection point 25 is located on the thickest portion in the opening terminal portion 28, thereby resulting in the improved vacuum resistant strength.

Figure 4:
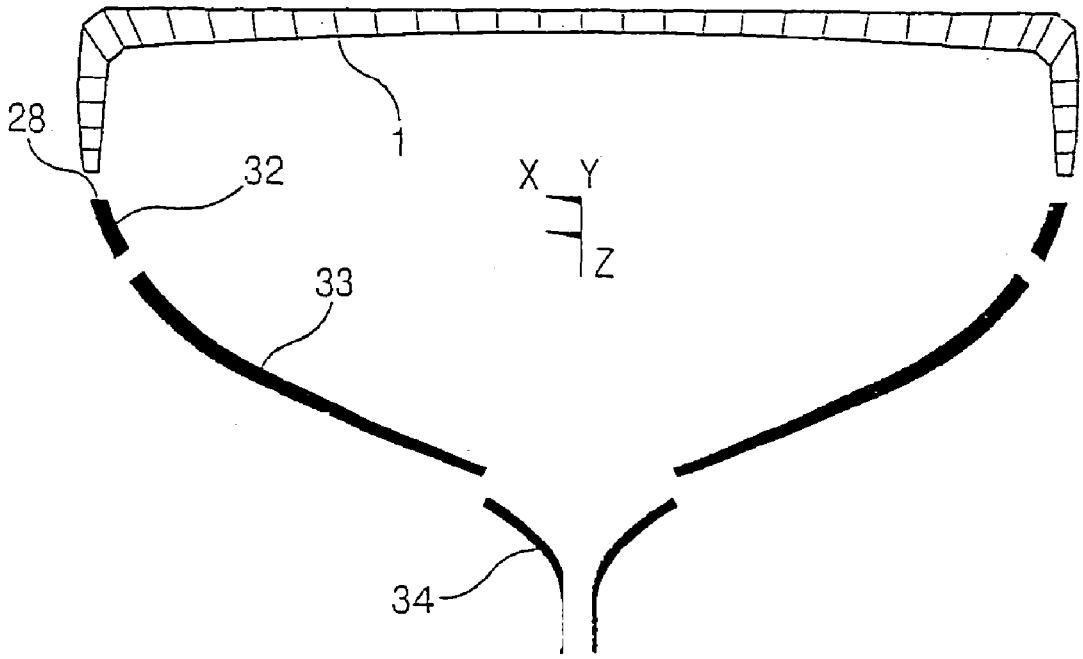
FIG. 4 is a diagram illustrating separated components of a funnel in accordance with a preferred embodiment of the present invention.

FIG. 4 is a diagram illustrating separated components of a funnel of a CRT in accordance with a preferred embodiment of the present invention. The funnel includes an opening terminal portion 28 attached to a panel 1, a yoke portion 34 whereon a deflection coil is mounted and a body portion. The body portion includes a lateral body portion 32 extending from the opening terminal portion 28, and a continuous body portion 33 connecting the lateral body portion 32 to the yoke portion 34.

Figure 5:
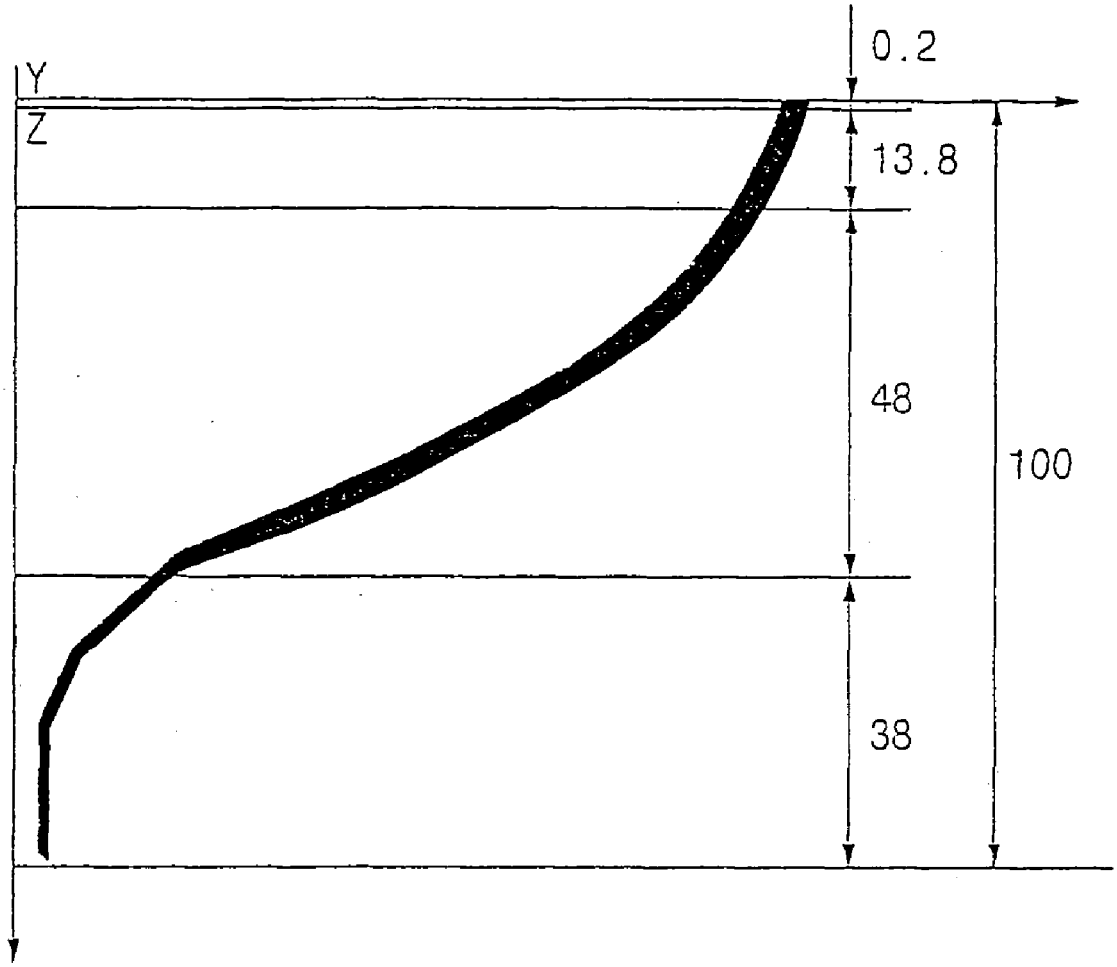
FIG. 5 is a diagram illustrating ratio to the Z-directional length of each component forming the whole funnel structure in accordance with a preferred embodiment of the present invention.

FIG. 5 is a diagram illustrating ratios to the Z-directional length of each component forming the whole funnel structure in accordance with a preferred embodiment of the present invention. Referring to FIGS. 4 and 5, if the total z-directional length of the funnel is 100, making the opening terminal portion 28 as the origin of a vertical axis line, the opening terminal portion 28 is 0.2, the lateral body portion 32 is 13.8, the continuous body portion 33 is 48, and the yoke portion 34 is 38, in its proportional relations. In case that the yoke portion 33 is connected to the continuous body portion 33 adjacent to the yoke portion 34, center of curvature of the continuous body portion 33 is located at the outer side of the CRT just as center of curvature of the yoke portion 34 is located at the outer side of the CRT. As a result, an inflection point is located apart from the yoke portion 34. FIG. 5 depicts a structure of a funnel of the CRT assembled in accordance with a preferred embodiment of the present invention. As shown in FIG. 5, since a structure according to a reverse curvature is maintained around the lateral body portion 32 and the continuous body portion 33 connected to the yoke portion 34, the stress becomes efficiently reduced.

In this way, the strength weakened by large deflection is improved, and the total length of the tube axis direction is simultaneously reduced by large deflection. As a result, the full length of the CRT in the tube axis direction becomes reduced, and the weight becomes also minimized in this present invention.

Figure 1:
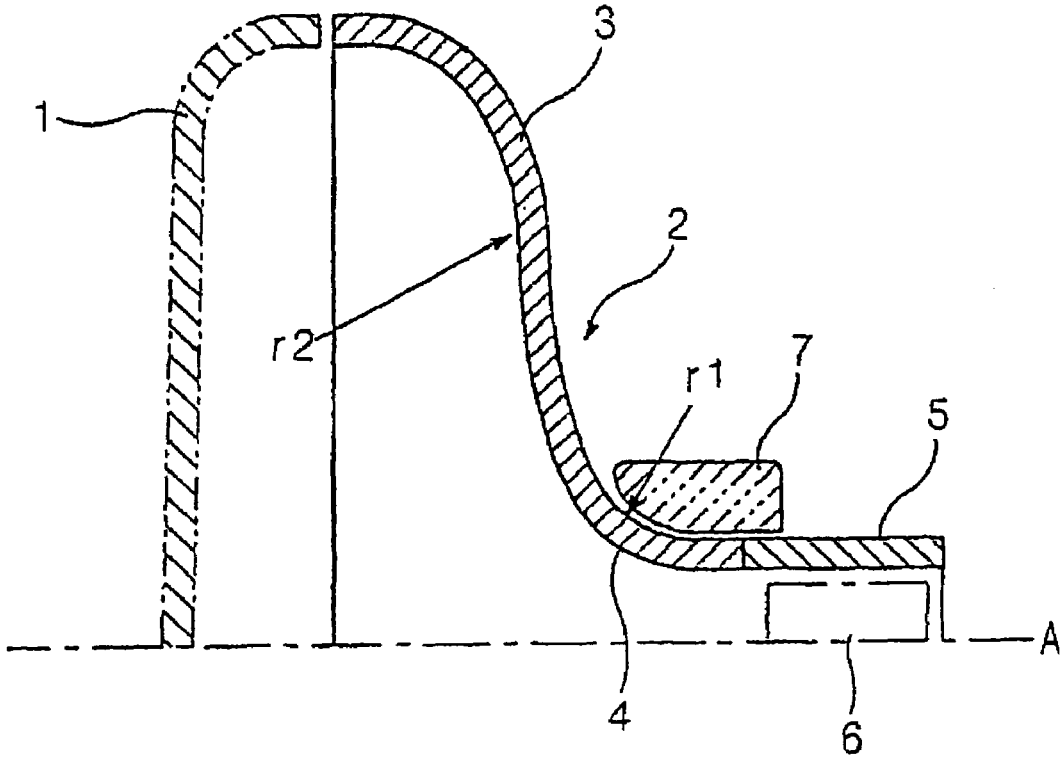
PRIOR ART Fig.1
FIG. 1 is a cross-sectional diagram illustrating a structure of a curvature in a funnel for a conventional CRT.
Figure 2:
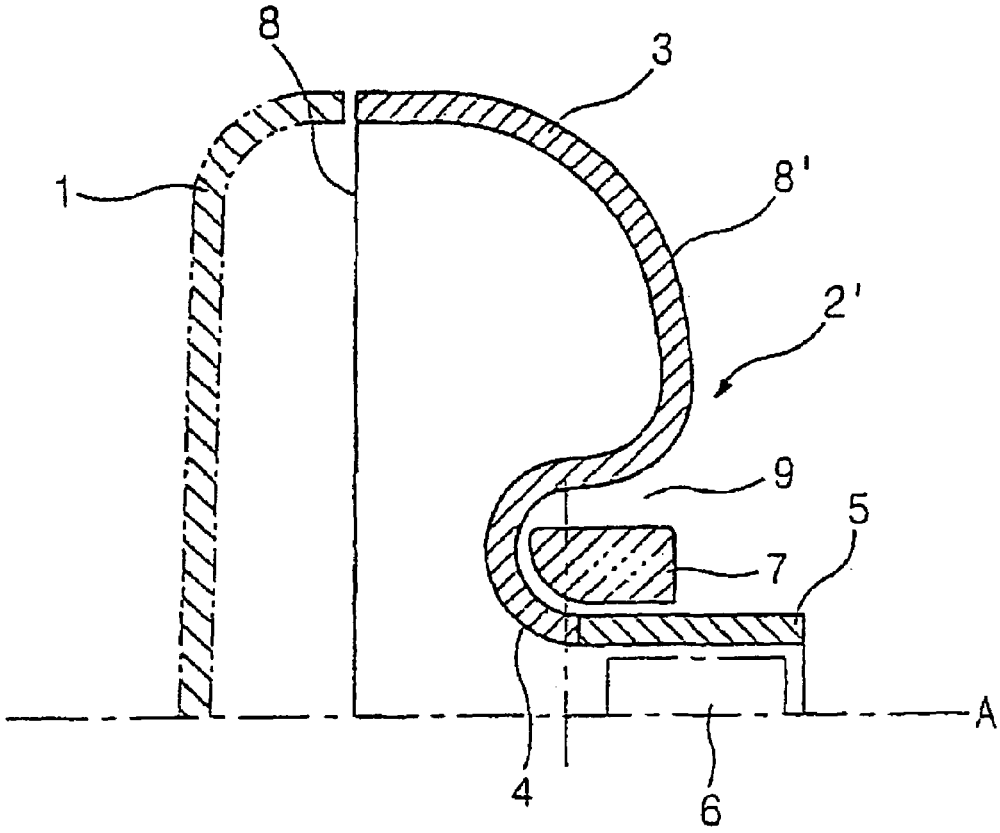
PRIOR ART Fig.2
FIG. 2 is a cross-sectional diagram illustrating a structure of a curvature in a funnel for another conventional CRT.
Figure 6:
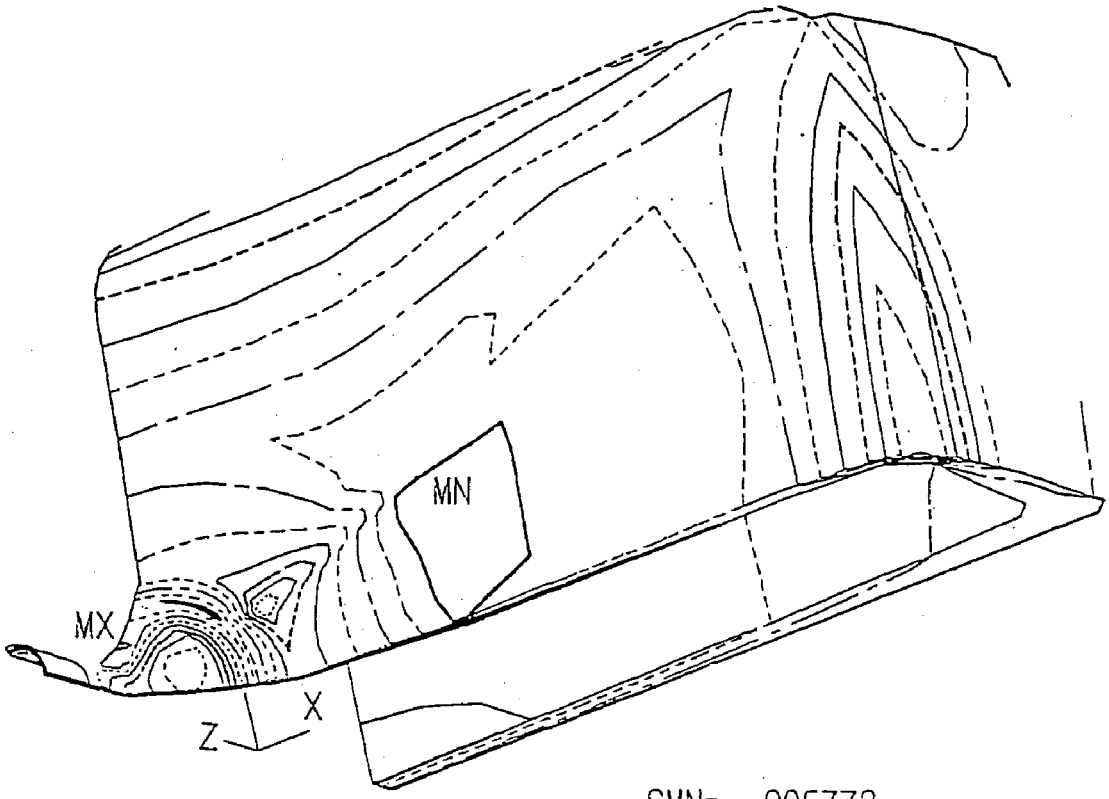
FIG. 6 is a graphical illustration of the stress distribution of a bulb assembling a funnel of FIG. 1 at a vacuum condition.
Figure 7:
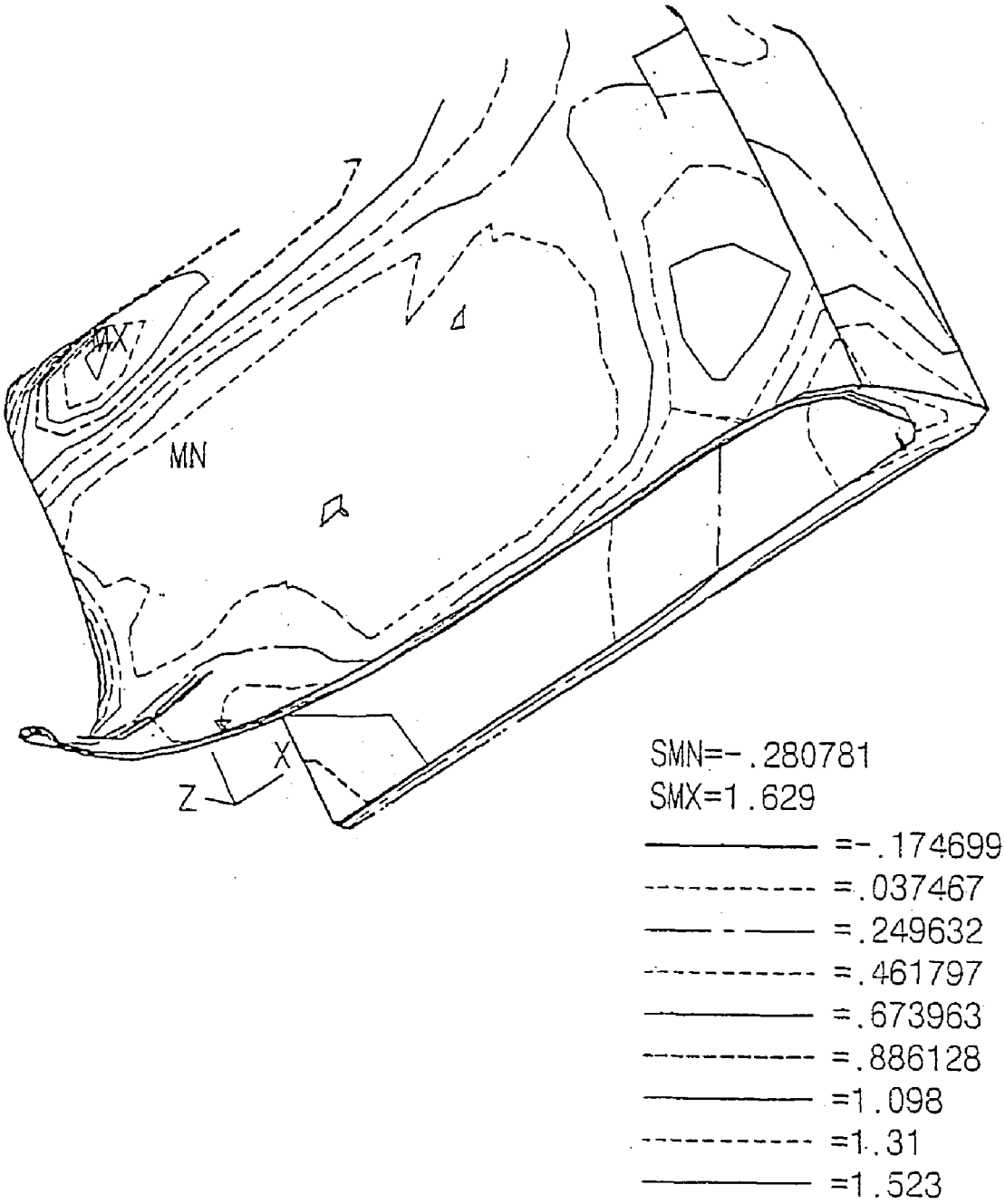
FIG. 7 is a graphical illustration of the stress distribution of a bulb assembling a funnel in accordance with a preferred embodiment of the present invention at a vacuum condition.
Figure 8:
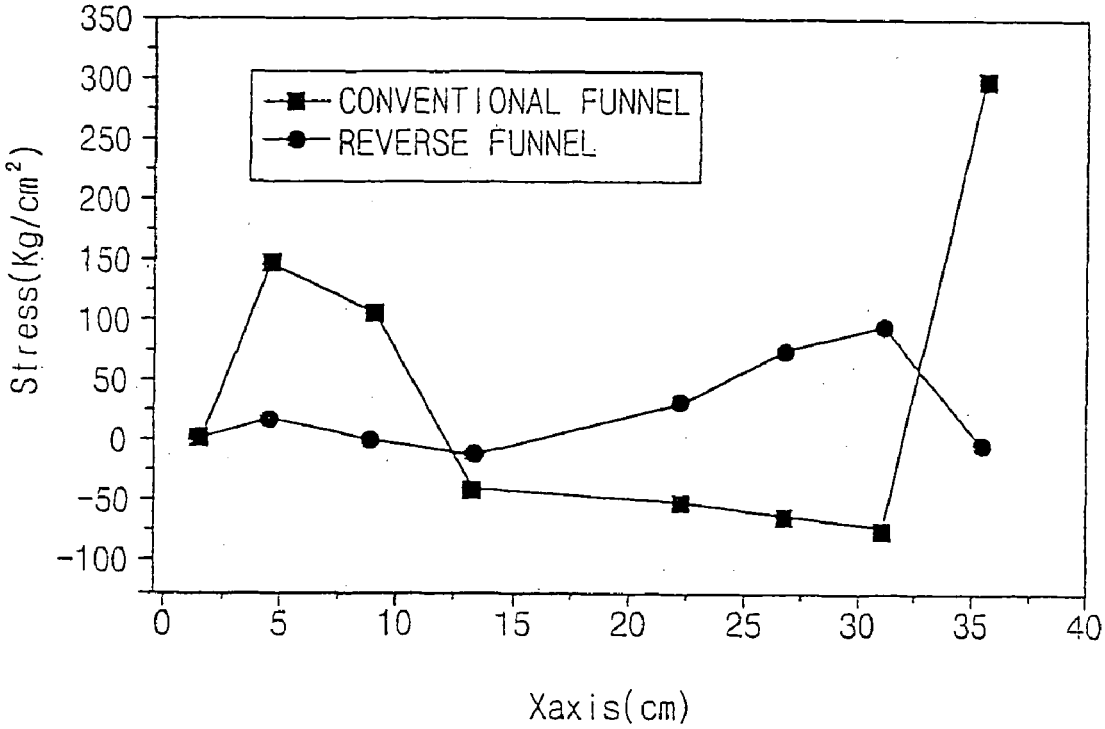
FIG. 8 is a graph comparing the stresses at each predetermined interval according to the X-direction from the center of a funnel in CRTs of FIGS. 6 and 7.

FIG. 6 shows a graphical illustration of the stress distribution of a conventional bulb assembling a funnel of FIG. 1 at a vacuum condition. FIG. 7 shows a graphical illustration of the stress distribution of a bulb assembling a funnel in accordance with a preferred embodiment of the present invention at a vacuum condition. FIGS. 6 and 7 is a computer simulation result for the upper portion on the right side of the CRT divided into four portions when the CRT in three-dimensions is seen from the rear. A symmetrical result and structure to X and Y axes respectively will be shown for the other portions. This computer simulation was performed with the same pressure as the vacuum condition of the CRT using the structural analysis program. FIG. 8 illustrates a graph comparing the stresses at each predetermined interval according to the X-axis direction from the center of a funnel in CRT of FIGS. 6 and 7. Here, 0 of a horizontal axis represents the center of the rear glass, that is, the funnel, and 35 of the horizontal axis represents the lateral body portion 32 which is the terminal portion on the right side of the rear glass. MX represents the maximum value while MN represents the minimum value.

Referring to FIGS. 6 and 7, the conventional cathode ray tube having curvature has the maximum stress in a yoke portion and a lateral body portion and the minimum stress in a body portion. On the contrary, a cathode ray tube according to the present invention has the maximum stress not in a yoke portion but in a continuous body portion. In addition, in the curvature structure of the present invention, the maximum stress generated from the whole cathode ray tube is 1.63 kgf/cm$^2$, while the maximum stress of the conventional CRT is 3.51 kgf/cm$^2$. Because the cathode ray tube of the present invention has the maximum stress in the continuous body portion designed to have relatively thick thickness and small stress in the yoke portion. As a result, the strength of the cathode ray tube is improved.

Referring to FIG. 8, the convention cathode ray tube has high stress in a lateral body portion as well as in a yoke portion. On the contrary, a cathode ray tube of the present invention has high stress in a continuous body portion. In respect of its stress value, the cathode ray tube of the present invention has relatively smaller stress value in the yoke portion than the conventional cathode ray tube. As a result, a funnel 20 for CRT of the present invention deals with vacuum and implosion conditions, satisfying the glass manufacturing process and test specification requirements.

Figure 9:
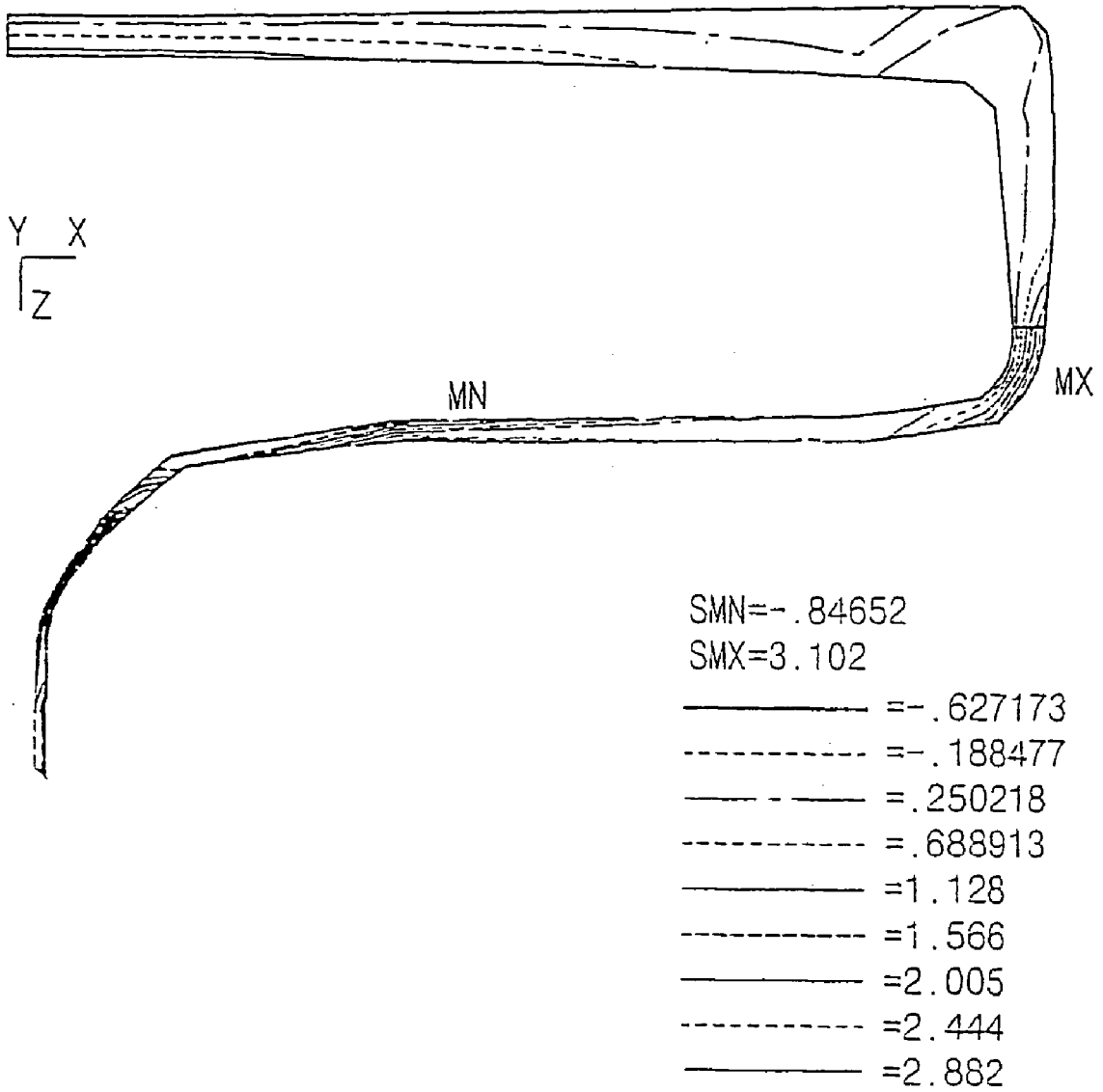
FIGS. 9 and 10 illustrate the stress distribution at a cross-section of a CRT in FIGS. 6 and 7 under the glass vacuum pressure condition for a large deflection.
Figure 10:
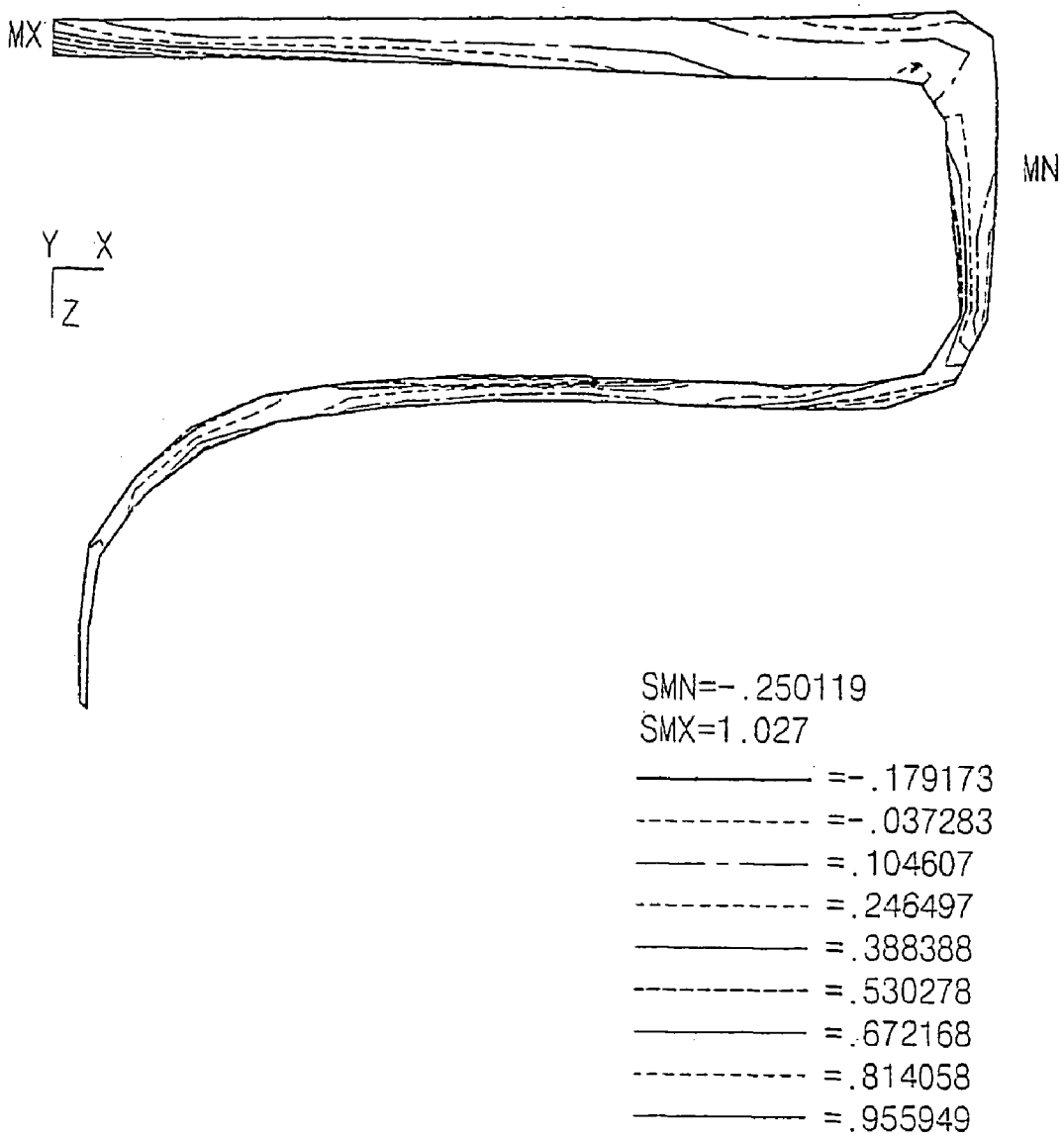

FIGS. 9 and 10 are graphical illustrations showing the stress distribution on a X-Z cross-section of a CRT in FIGS. 6 and 7 at glass vacuum pressure condition for a large deflection CRT using a program for structural analysis program. The boundary condition applied to this model is pressure difference resulting from the process of fabricating general CRT. The internal pressure of CRT is $10^{-7}$ torr, the external pressure of CRT is atmospheric pressure, 760 torr.

FIG. 9 illustrates the stress distribution under vacuum pressure condition of the conventional model wherein curvature center of a continuous body portion 33 is located at the inside of CRT. FIG. 10 illustrates the stress distribution under vacuum pressure condition in accordance with a preferred embodiment of the present invention, wherein reverse curvature is applied to a continuous body portion.

In respect of stress value in the funnel, the conventional model has the largest value of 3.10 Kgf/cm$^2$ in a lateral body portion 32 of the funnel, and also high stress in a yoke portion. On the contrary, a model having reverse curvature has the maximum stress of 1.02 Kgf/cm$^2$ in a front panel, and also high stress around a continuous body portion 33. However, the stress value is remarkable reduced in comparison with the conventional one. Therefore, the cathode ray tube having funnel with reverse curvature according to the present invention has the reduced maximum stress in comparison with the conventional CRT, as shown in the results of FIGS. 6 and 7. According to the CRT of the present invention, the stress is shown highly in a continuous body portion which is relatively strong to the stress, while the stress not shown highly in a yoke portion which is relatively weak to the stress.

Accordingly, in the model having reverse curvature according to the present invention, the stress resistant strength is improved to over 54%. As a result, it can be known that the model having reverse curvature is structurally secure.

As discussed above, a CRT having funnel with reverse curvature according to a preferred embodiment of the present invention deals with vacuum and implosion condition, and satisfies the glass manufacturing process and the test specification requirements. In addition, the CRT of the present invention also improves the weaken strength due to large deflection of electric beam, reduces the full length of CRT in a tube axis direction, and minimizes the weight.

What is claimed is:

1. A cathode ray tube having a funnel with a reverse curvature, comprising:

a yoke portion on which a deflection coil is placed, and a body portion extending from the yoke portion toward an opening terminal portion, the yoke portion attached to a panel;

wherein an inflection point is located away from the yoke portion by placing a center of curvature in the body portion extending from the yoke portion on an outer side of the cathode ray tube and placing a center of curvature in the yoke portion on the outer side of the cathode ray tube.

2. The cathode ray tube having the funnel with the reverse curvature according to claim 1, wherein a center of curvature R1 in the yoke portion is located at the outer side of the cathode ray tube, centers of curvatures R2 and R3 in the yoke portion near to the body portion extending from the yoke portion are located at the outer side of the cathode ray tube, and a center of curvature R4 in the opening terminal portion near to the body portion is located at an inner side of the cathode ray tube, thereby the inflection point is located in the body portion near to the opening terminal portion.

3. The cathode ray tube having the funnel with the reverse curvature according to claim 2, wherein the curvatures R2 and R3 of the yoke portion near to the body portion comprise a plurality of curvatures.

4. The cathode ray tube having the funnel with the reverse curvature according to claim 2, wherein the inflection point is located near the opening terminal portion which is a thickest portion.

5. The cathode ray tube having the funnel with the reverse curvature according to claim 1:

wherein the body portion comprises a lateral body portion extending from the opening terminal portion and a continuous body portion connecting the lateral body portion to the yoke portion;

wherein if a whole straight length from an origin of the opening terminal portion to the yoke portion is 100, the opening terminal portion is 0.2, the lateral body portion is 13.8 the continuous body portion is 48, and the yoke portion is 38; and wherein a center of curvature in the continuous body portion connecting the lateral body portion to the yoke portion is located at the outer side of the cathode ray tube to maintain a structure of reverse curvature.

6. The cathode ray tube having the funnel with the reverse curvature according to claim 1, wherein the inflection point is located near the opening terminal portion which is a thickest portion.

* * * * *